US010518322B2

(12) United States Patent
Chow et al.

(10) Patent No.: US 10,518,322 B2
(45) Date of Patent: Dec. 31, 2019

(54) CASTING FUNNEL

(71) Applicant: United Technologies Corporation, Hartford, CT (US)

(72) Inventors: Wai Tuck Chow, Singapore (SG); Yan Seng Loh, Singapore (SG)

(73) Assignee: United Technologies Corporation, Farmington, CT (US)

( * ) Notice: Subject to any disclaimer, the term of this patent is extended or adjusted under 35 U.S.C. 154(b) by 678 days.

(21) Appl. No.: 14/437,017

(22) PCT Filed: Oct. 16, 2013

(86) PCT No.: PCT/SG2013/000440
§ 371 (c)(1),
(2) Date: Apr. 20, 2015

(87) PCT Pub. No.: WO2014/065755
PCT Pub. Date: May 1, 2014

(65) Prior Publication Data

US 2015/0258608 A1 Sep. 17, 2015

(30) Foreign Application Priority Data

Oct. 24, 2012 (SG) ..... 201207911-7

(51) Int. Cl.
*B22D 41/50* (2006.01)
*B22D 17/20* (2006.01)

(52) U.S. Cl.
CPC ..... *B22D 41/50* (2013.01); *B22D 17/20* (2013.01); *B22D 17/203* (2013.01)

(58) Field of Classification Search
CPC ..... B22D 17/20; B22D 17/203; B22D 17/30; B22D 17/2023; B22D 41/50; B22D 11/145; B22D 35/04
See application file for complete search history.

(56) References Cited

U.S. PATENT DOCUMENTS

| | | | | |
|---|---|---|---|---|
| 2,435,610 A | | 2/1948 | Schneider | |
| 3,201,835 A | | 8/1965 | Cooper et al. | |
| 3,844,337 A | * | 10/1974 | Bessett | B22C 9/082 141/337 |
| 4,059,143 A | | 11/1977 | Morita et al. | |
| 4,485,839 A | * | 12/1984 | Ward | B22D 19/14 164/423 |

(Continued)

FOREIGN PATENT DOCUMENTS

| | | | |
|---|---|---|---|
| DE | 102010041592 A1 * | 3/2012 | B22D 17/30 |
| EP | 2450129 | 5/2012 | |
| GB | 2129343 | 5/1984 | |

OTHER PUBLICATIONS

Extended European Search Report for Application No. 13848945.5 dated May 6, 2016.

(Continued)

*Primary Examiner* — Kevin P Kerns
*Assistant Examiner* — Steven S Ha
(74) *Attorney, Agent, or Firm* — Carlson, Gaskey & Olds, P.C.

(57) ABSTRACT

An example molten material funnel includes a first outlet lip and a second outlet lip. The first and second outlet lips are configured to both contact molten material communicated through the molten material funnel.

18 Claims, 5 Drawing Sheets

(56) References Cited

U.S. PATENT DOCUMENTS

| | | | | |
|---|---|---|---|---|
| 5,429,175 | A | 7/1995 | Thieman et al. | |
| 6,058,794 | A | 5/2000 | Hempel | |
| 6,186,220 | B1 | 2/2001 | Sucker et al. | |
| 2001/0002617 | A1* | 6/2001 | Schofield | B22D 17/14 164/61 |
| 2004/0055727 | A1 | 3/2004 | Hong et al. | |
| 2007/0137827 | A1* | 6/2007 | Vogt | B22C 9/04 164/113 |
| 2007/0187061 | A1 | 8/2007 | Siddle et al. | |

OTHER PUBLICATIONS

Bing Huang, Heat Transfer Under an Inclined Slot Jet Impinging on a Moving Surface, Department of Chemical Engineering, McGill University, Montreal, Sep. 1988, pp. 270.

International Search Report dated Jan. 16, 2014.

Singapore Search Report and Written Opinion for Application No. 201207911-7 dated Oct. 15, 2013.

* cited by examiner

CASTING FUNNEL

BACKGROUND

This disclosure relates generally to a casting assembly and, more particularly, to a funnel that communicates molten material to a die during the casting process.

Many components are cast, including components of gas turbine engines and other machines. During the casting process, molten material is typically communicated from a crucible to a shot tube. A piston is then actuated to move the molten material from the shot tube to the die or (mold). The molten material solidifies within the die to form the component.

As shown in FIG. 1, in a prior art arrangement, molten material M is poured from a crucible 10 into a funnel 12 that delivers the molten material M to a shot tube 14. The temperature of the molten material may exceed 1500 degrees Fahrenheit (816 degrees Celsius). The molten material M drops through the funnel 12 impinges directly on the shot tube 14 at an area $A_p$. The molten material M does not impinge on the funnel 12. Over time, this impingement of the high-temperature molten material M can stress the shot tube 14, and particularly area $A_p$ of the shot tube 14. The area $A_p$ may become cracked in as few as 10 to 20 casting cycles. Replacing the shot tube 14 is expensive. A normal impingement angle on the shot tube 14 may lead to air mixing with molten material.

SUMMARY

A molten material funnel according to an exemplary aspect of the present disclosure includes, among other things, a first outlet lip of a molten material funnel, and an opposing, second outlet lip of the molten material funnel. The first and second outlet lips are configured to both contact molten material communicated through the molten material funnel.

In a further non-limiting embodiment of the foregoing molten material funnel, molten material may move in a direction D into the molten material funnel. The first outlet lip and the second outlet lip may both be angled relative to the direction D.

In a further non-limiting embodiment of the either of the foregoing molten material funnels, an angle of the first outlet lip relative to the direction D is greater than an angle of the second outlet lip relative to the direction D.

In a further non-limiting embodiment of any of the foregoing molten material funnels, an angle of the first outlet lip relative to the direction D may be greater than 40 degrees, and the angle of the second outlet lip relative to the direction D may be less than 40 degrees.

In a further non-limiting embodiment of any of the foregoing molten material funnels, an angle of the first outlet lip relative to the direction D may be about 40 degrees, and the angle of the second outlet lip relative to the direction D may be about 25 degrees.

In a further non-limiting embodiment of any of the foregoing molten material funnels, the molten material may communicate from the molten material funnel to an opening in a shot tube. The opening may extend radially from a bore of the shot tube.

In a further non-limiting embodiment of any of the foregoing molten material funnels, molten material may move in a direction D into the funnel. The direction D may be normal to a tangent of the bore.

In a further non-limiting embodiment of any of the foregoing molten material funnels, the opening may include a first portion and a second portion. The first portion may extend from the bore along an first axis that is angled relative to the direction D. The second portion may extend from the first portion along a second axis that is angled relative to the first axis.

In a further non-limiting embodiment of any of the foregoing molten material funnels, the first outlet lip may be configured to directly contact the shot tube in the second portion.

In a further non-limiting embodiment of any of the foregoing molten material funnels, the first and second outlet lips are configured to reduce an impingement angle of the molten material at a location where the molten metal first contacts the shot tube to less than 60 degrees from a tangent of a bore of the shot tube taken at the location.

In a further non-limiting embodiment of any of the foregoing molten material funnels, at least one of the first and second outlet lips may comprise a replaceable sheet.

In a further non-limiting embodiment of any of the foregoing molten material funnels, the replaceable sheet may comprise a steel, a superalloy, a refractory metal, ceramic or a hybrid material.

In a further non-limiting embodiment of any of the foregoing molten material funnels, the first outlet lip may extend from a first wall of the molten material funnel. The second outlet lip may extend from an opposing, second wall of the molten material funnel.

In a further non-limiting embodiment of any of the foregoing molten material funnels, molten material may move in a direction D into the molten material funnel. The first wall and the second wall may be aligned with the direction D.

A casting assembly according to an exemplary aspect of the present disclosure includes, among other things, a supply of molten material, a shot tube that communicates molten material to a die, and a funnel having at least one outlet lip. The funnel is configured to communicate molten material from the supply to the shot tube such that the molten material impinges on the at least one outlet lip.

In a further non-limiting embodiment of the foregoing casting assembly, the at least one outlet lip may comprise a first outlet lip and a second outlet lip. The funnel is configured to communicate molten material from the first outlet lip to the second outlet lip, and then to the shot tube.

In a further non-limiting embodiment of either of the foregoing casting assemblies, the at least one outlet lip may comprise a removable plate.

In a further non-limiting embodiment of any of the foregoing casting assemblies, a piston may move the molten material from the shot tube to the die.

In a further non-limiting embodiment of any of the foregoing casting assemblies, the die may comprise a mold cavity for a turbomachine component.

A method of communicating molten material according to an exemplary aspect of the present disclosure includes, among other things, impinging a flow of molten material on a surface of a funnel prior to communicating the molten material to a die cavity.

In a further non-limiting embodiment of the foregoing method of communicating, the method may include impinging the molten material on both a first outlet lip and a second outlet lip of the funnel.

In a further non-limiting embodiment of the foregoing method of communicating, the method using at least three distinct funnel orientations to communicate molten material to at least three distinct areas of a shot tube.

DESCRIPTION OF THE FIGURES

The various features and advantages of the disclosed examples will become apparent to those skilled in the art from the detailed description. The figures that accompany the detailed description can be briefly described as follows.

DETAILED DESCRIPTION

Figure 1:
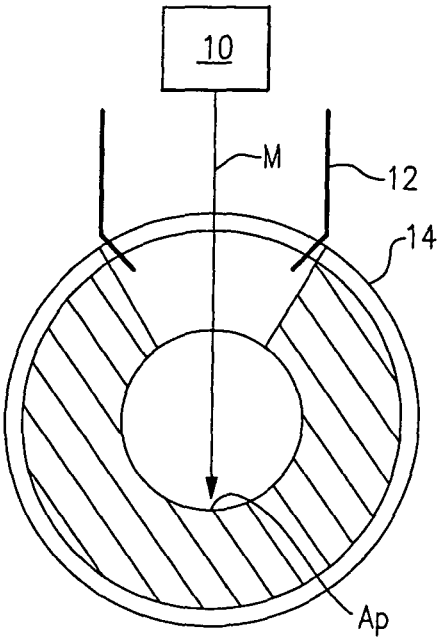
FIG.1 Prior Art
FIG. 1 shows a cross-section view of a prior art funnel and shot tube.
Figure 2:
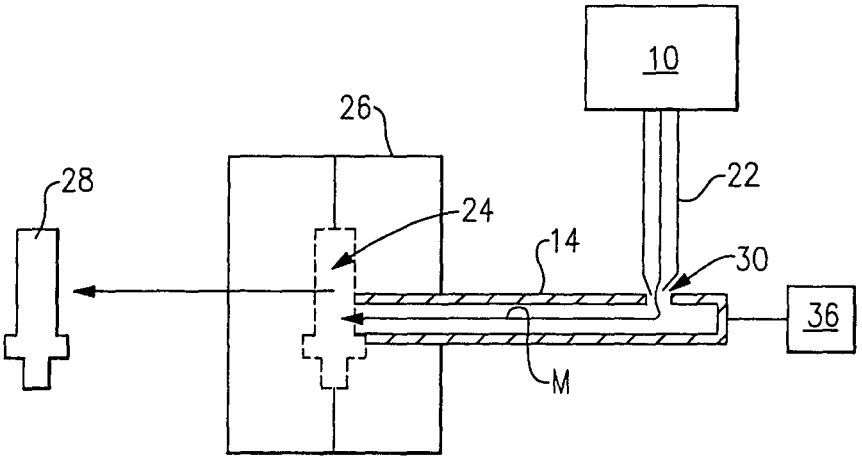
FIG. 2 shows a schematic view of a casting assembly.
Figure 3:
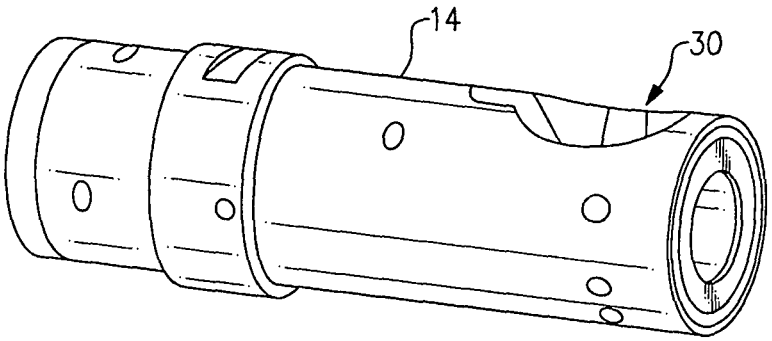
FIG. 3 shows a perspective view of a portion of an example shot tube.
Figure 4:
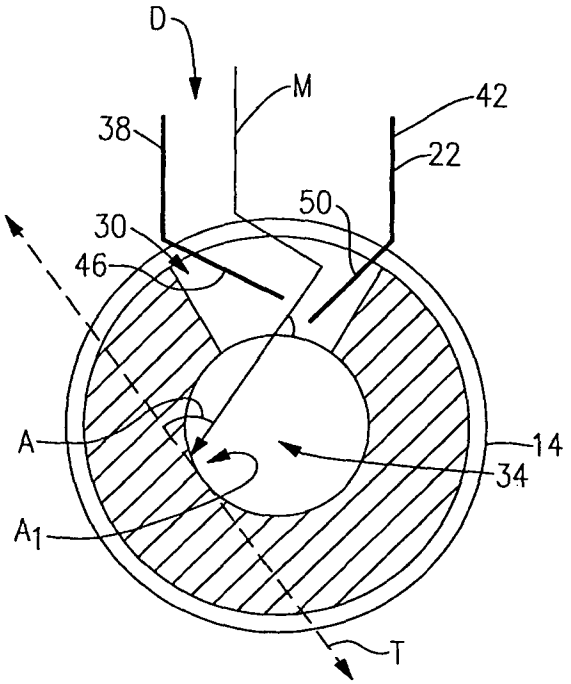
FIG. 4 shows a section view of an example funnel used to introduce molten material to the shot tube of FIG. 3.

Referring to FIGS. 2-4, a casting assembly an example funnel 22 delivers molten material from a supply 10, such as a crucible, to a shot tube 14, which then communicates the molten material M to a die cavity 24 within a die 26. The molten material M hardens within the die cavity 24 to form a component 28.

In this example, the formed component 28 is an airfoil, such as a blade or a vane, from a high-pressure compressor of a gas turbine engine or another type of turbomachine. Molten material M may harden within the die cavity 24 to form other types of components in other examples.

The shot tube 14 includes an opening 30. The funnel 22 is partially received within the opening 30. The opening 30 extends radially from a bore 34 within the shot tube 14. Molten material M (delivered from the funnel 22) enters the bore 34 through the opening 30. A piston 36 is then actuated to push the molten material M into the die cavity 24. The example funnel 22 is configured to deliver the molten material and through the opening 30 to the bore 34 in a way that lessens the stress on the shot tube 14.

In this example, the funnel 22 includes a first wall 38 and an opposing, second wall 42. A first outlet lip 46 is secured to the first wall 38. A second outlet lip 50 is secured to the second wall 42.

When the molten material M is poured from the crucible 10, the molten material M moves initially in a direction D that is vertical and is normal to a tangent T of the bore 34. The first wall 38 and the second wall 42 are aligned with the direction D. The first outlet lip 46 and the second outlet lip 50 are angled relative to the direction D. The first outlet lip 46 and the second outlet lip 50 cause the molten material M to change direction.

In this example, the first outlet lip 46 is bent such that the molten material M impinges on the first outlet lip 46 prior to entering the bore 34 and prior to contacting any portion of the shot tube 14. The first outlet lip 46 is greater than 40 degrees in some examples. In a specific example, the first outlet lip is angled about 40 degrees from the direction D in this example.

After the molten material has flown along the first outlet lip 46, the molten material M impinges onto the second outlet lip 50. The second outlet lip 50 is less than 40 degrees in some examples. In a specific example, the second outlet lip 50 is angled about 25 degrees from the direction D. Notably, in these examples, the angle of the second outlet lip 50 relative to the direction D is less than the angle of the first outlet lip 46 relative to the direction D.

The molten material M then flows along the second outlet lip 50 and moves through the remaining portion of the opening 30 into the bore 34. The molten material M passing through the funnel 22 thus contacts both the first outlet lip 46 and the second outlet lip 50 before entering the bore 34, and before contacting any portion of the shot tube 14.

Impinging the molten materials directly on the first outlet lip 46, and then the second outlet lip 50, instead of directly on the shot tube 14 slows the movement of the molten material, and lessens the stresses exerted on the shot tube 14 by the molten material M.

The example funnel 22 directs the molten material M through the opening 30 into the bore 34 in a direction that has an angle A about 60° or less from the tangent T of the bore 34. The first and second outlet lips 46 and 50 are configured to reduce an impingement angle of the molten material on the shot tube 14 to less than 60 degrees from a tangent T of the bore 34 of the shot tube 14. The molten material M swirls within the bore 34 when directed into the bore 34 in this way. The swirling lessens the impact velocity exerted on the shot tube 14 by the molten material M. The swirling is generally swirling about an axis of the bore 34.

Figure 5:
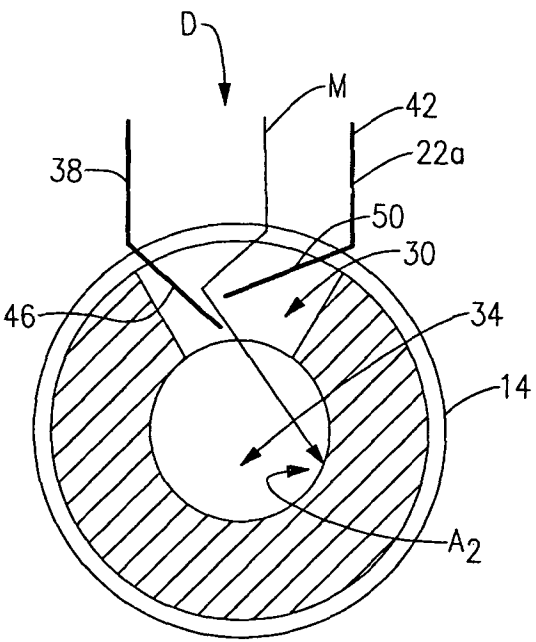
FIG. 5 shows a section view of the funnel of FIG. 4 in another orientation.

When the funnel 22 is used with the shot tube 14, the molten material M is directed primarily at an area $A_1$ of the shot tube 14. The stresses on the shot tube 14 are thus concentrated at the $A_1$. Over multiple cycles of casting, the first outlet lip 46 may become worn due to the molten material directly impinging on the first outlet lip 46, particularly the area $A_1$. After sufficient wear on the funnel 22, the funnel 22 may be replaced with a funnel **22*a* (FIG. 5) that directs the molten material to an $A_2$ of the shot tube 14. The area $A_2$ is different than the area $A_1$. When the funnel 22*a* is used, the stresses on the shot tube 14 are concentrated at the area $A_2$. Selectively utilizing the funnels 22 and 22*a* introduces the molten material M into different areas ($A_1$ and $A_2$) of the shot tube 14, which spreads out the stresses on the shot tube 14 and may extend the life of the shot tube 14. Notably, the funnel 22*a* may be funnel 22** oriented in a different orientation.

Figure 6:
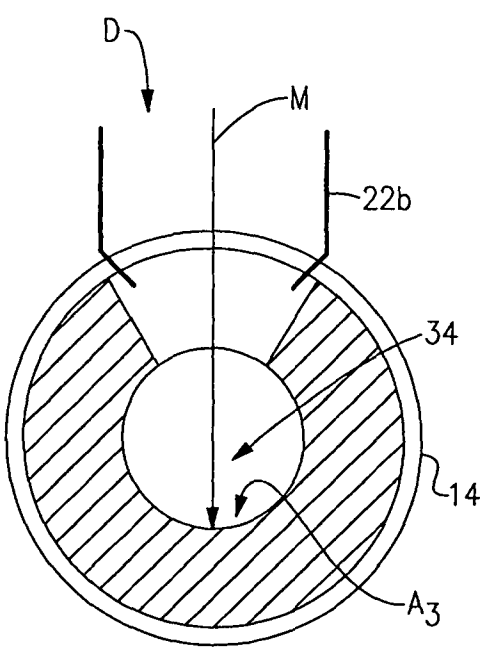
FIG. 6 shows a section view of the prior art funnel of FIG. 1.

After additional cycles, the first outlet lip 46 of the funnel **22*a* may become worn. The funnel 22*a* may then be replaced with a funnel 22*b* (FIG. 6). The funnel 22*b* focuses the molten material M onto an area $A_3$ of the shot tube 14. Three different types (or orientations) of funnels 22, 22*a*, and 22*b* thus may be used to focus the molten material M to different areas ($A_1$, $A_2$, and $A_3$) of the shot tube 14. The life of the shot tube 14 is thus extended because three areas, rather than one, are first contacted by the molten material M when introducing the molten material M to the shot tube 14. Replacing the funnel, rather than the shot tube 14, is less costly replacement then replacing the shot tube 14**.

The shot tube 14, in this example, is made of steel. In other examples, the shot tube 14 made of a ceramic, silicon nitride etc. In another example, the shot tube is 14 made of hybrid materials.

The molten material M is typically steel, but could be a nickel alloy, bronze material, etc.

The funnels 22, 22*a*, and 22*b* may be made of steel, superalloy (Ni, Co alloys), refractory metals (W, Mo alloys), ceramics (Si3N4, SC etc), or hybrid materials.

Figure 7:
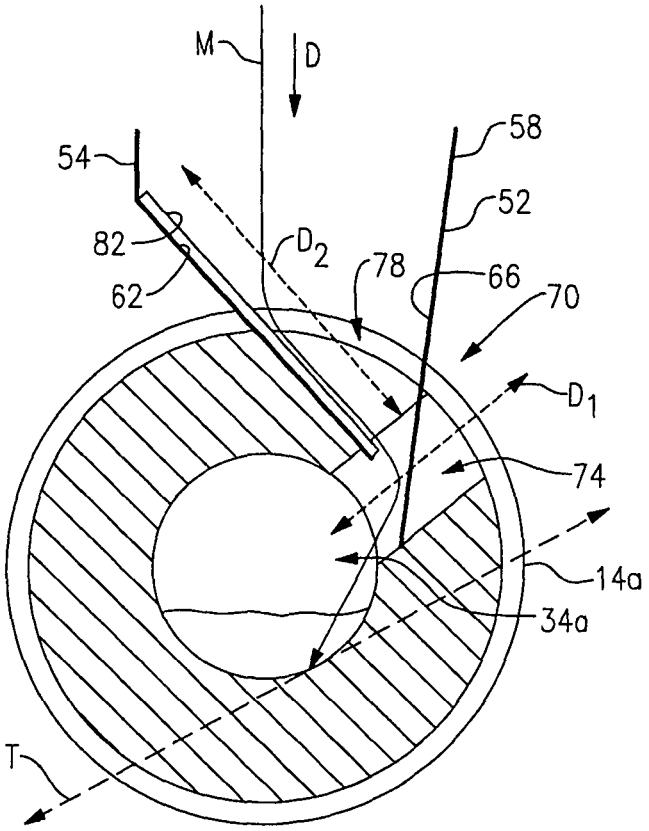
FIG. 7 shows a section view of another example funnel used with another example shot tube.
Figure 8:
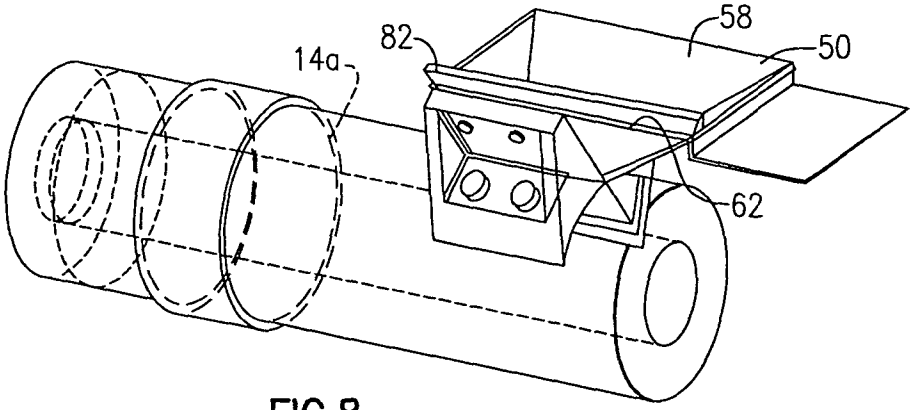
FIG. 8 shows a perspective view of the funnel of FIG. 7.
Figure 10:
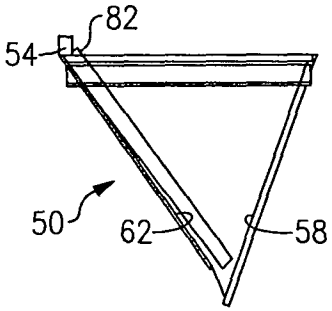
FIG. 10 shows a front view of the funnel of FIG. 7.
Figure 9:
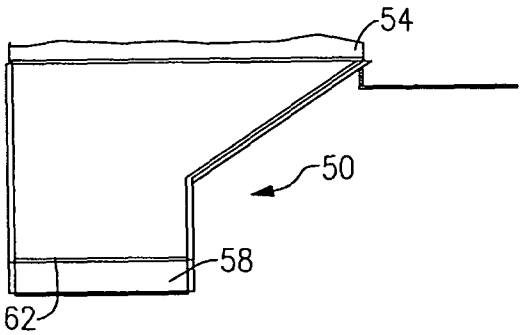
FIG. 9 shows a side view of the funnel of FIG. 7.

Referring to FIG. 7, another example funnel 52 includes a first wall 54 and an opposing, second wall 58. A first outlet lip 62 extends from the first wall 54. A second outlet lip 66 extends from the second wall 58.

The shot tube 14*a* in this example, has an opening 70 that is designed to accommodate the funnel 52. The opening 70 includes a first area 74 and a second area 78. The first area 74 extends radially from a bore 34*a* in a direction $D_1$ that is approximately 45° clockwise from the direction D. The second area 78 extends in a direction $D_2$ that is approximately 45° counter-clockwise from the direction D. The second area 78 that is machined into the shot tube 14 to accommodate the first outlet lip 62. The first outlet lip 62 may directly above the shot tube 14 in the second area 78.

When introducing molten material M into the funnel 52, the molten material M first impinges against the first outlet lip 62, then the second outlet lip 66 before moving into the bore 34*a*. The impingement angle on the funnel 52 is less than the impingement angle on the funnel 22. Thus, the temperature on the first outlet lip 62 may be lower than if the molten material were introduced into the funnel 22. The molten material M also may be less prone to build-up on the first outlet lip 62 than the first outlet lip 46 of the funnel 22.

The first outlet lip 62 may include a sheet 82. When molten material moves through the funnel 52, the molten material M directly impinges on the sheet 82 of the funnel 52. Over multiple cycles of introducing the molten material M to the funnel 52 the sheet 82 may become worn. The sheet 82 is replaceable and, if worn, be replaced with another sheet, rather than replacing the entire funnel 52. Replacing the sheet 82 is often less expensive than replacing the entire funnel 52. The sheet 82 may be made of steel, superalloy (Ni, Co alloys), refractory metals (W, Mo alloys), ceramics (Si3N4, SC etc) and hybrid material. The second outlet lip 58, may also include a replaceable sheet.

Because the opening 30*a* of the shot tube 14*a* is rotated slightly (relative to the opening 30) and interfaces with the bore 34*a* at a lower vertical position than the interface of the opening 30 with the bore 34, the bore 34*a* has a lower potential fill area than the bore 34. In this example, the fill ratio of the shot tube 14 A is below 30%. In the shot tube 14, the fill ratio of the bore 34 is about 80%.

Features of some of the disclosed examples include reducing the velocity of the molten metal and the angle of impingement onto the bore of the shot tube by directing the molten metal to impinge onto the two outlet lips of the funnel first before impinging onto the inner bore of the shot tube, the. As a result, the heat damage onto the shot tube is reduced and the life of the shot tube, which is significantly more expensive than the funnel, is extended. In some examples, the angles of the two outlet lips may be designed to reduce the angle of impingement of the molten metal onto the bore of the shot tube without inducing excessive splashing. In some more-specific examples, the funnel is designed to reduce the impingement angle of the molten metal to less than 60 degree from the tangent of the bore.

The preceding description is exemplary rather than limiting in nature. Variations and modifications to the disclosed examples may become apparent to those skilled in the art that do not necessarily depart from the essence of this disclosure. Thus, the scope of legal protection given to this disclosure can only be determined by studying the following claims.

We claim:

1. A molten material funnel, comprising:

a first outlet; and a second outlet, wherein the first and second outlets both face at least partially vertically upward such that an amount of molten material communicated through the molten material funnel impinges on both the first and second outlets, wherein at least one outlet comprises a replaceable sheet.

2. The molten material funnel of claim 1, wherein molten material moves in a vertical direction D into the molten material funnel, the first outlet and the second outlet both angled relative to the direction D.

3. The molten material funnel of claim 2, wherein an angle of the first outlet relative to the direction D is greater than an angle of the second outlet relative to the direction D.

4. The molten material funnel of claim 2, wherein an angle of the first outlet relative to the direction D is greater than 40 degrees, and the angle of the second outlet relative to the direction D is less than 40 degrees.

5. The molten material funnel of claim 2, wherein an angle of the first outlet relative to the direction D is about 40 degrees, and the angle of the second outlet relative to the direction D is about 25 degrees.

6. The molten material funnel of claim 2, wherein the first and second outlets both face at least partially in a direction opposite the direction D.

7. The molten material funnel of claim 1, wherein the molten material communicates from the molten material funnel to an opening in a shot tube, the opening extending radially from a bore of the shot tube.

8. The molten material funnel of claim 7, wherein molten material moves in a vertical direction D into the molten material funnel, the direction D normal to a tangent of the bore.

9. The molten material funnel of claim 8, wherein the opening includes first portion and a second portion, the first portion extending from the bore along an first axis that is angled relative to the direction D, the second portion extending from the first portion along a second axis that is angled relative to the first axis.

10. The molten material funnel of claim 9, wherein the first outlet is configured to directly contact the shot tube in the second portion.

11. The molten material funnel of claim 1, wherein the first and second outlets are configured to reduce an impingement angle of the molten material on a shot tube to less than 60 degrees from a tangent of a bore of the shot tube, wherein the molten material funnel is configured to receive molten material moved in a vertical direction D into the molten material funnel, and the direction D is normal to the tangent of the bore.

12. The molten material funnel of claim 1, wherein the first outlet extends from a first wall of the molten material funnel, and the second outlet extends from an opposing, second wall of the molten material funnel, the first wall positioned entirely between an inlet to the molten material funnel and the first outlet, the second wall positioned entirely between the inlet to the molten material funnel and the second outlet.

13. The molten material funnel of claim 12, wherein molten material moves in a vertical direction D into the molten material funnel, the first wall and the second wall aligned parallel to the direction D.

14. A molten material funnel, comprising:

a first outlet; and a second outlet, wherein first and second outlets both face at least partially vertically upward such that an amount of molten material communicated through the molten material funnel impinges on both the first and second outlet, wherein at least one outlet comprises a replaceable sheet, wherein both the molten material funnel and replaceable sheet comprises a steel, a superalloy, a refractory metal, a ceramic or a hybrid material.

15. A casting assembly, comprising:

a supply of molten material;

a shot tube that communicates molten material to a die; and a funnel having a first outlet and a second outlet, the funnel configured to communicate molten material from the supply to the shot tube in a first direction such that an amount of the molten material impinges on both the first and second outlets, the first and second outlets facing at least partially in a second direction opposite the first direction, wherein at least one outlet comprises a removable plate.

16. The casting assembly of claim 15, wherein the die comprises a mold cavity for a turbomachine component.

17. The casting assembly of claim 15, wherein the funnel is configured to communicate the molten material vertically downward toward the first and second outlets, and the first and second outlets face, at least partially, vertically upward.

18. A method of communicating molten material, comprising:

impinging a flow of molten material on a surface of a funnel prior to communicating the molten material to a die cavity, and using at least three distinct funnel orientations to communicate molten material to at least three distinct areas of a shot tube.

* * * * *